US007602289B2

(12) United States Patent
Ashizawa et al.

(10) Patent No.: US 7,602,289 B2
(45) Date of Patent: Oct. 13, 2009

(54) CONNECTOR DEVICE, APPARATUS AND METHOD FOR ACQUIRING DATA OF ELECTRICAL DEVICE USING THE CONNECTOR DEVICE, AND CONTROL SYSTEM FOR ELECTRICAL DEVICE

(75) Inventors: Minoru Ashizawa, Tokyo (JP); Isao Sakama, Hiratsuka (JP)

(73) Assignee: Hitachi, Ltd., Tokyo (JP)

( * ) Notice: Subject to any disclaimer, the term of this patent is extended or adjusted under 35 U.S.C. 154(b) by 718 days.

(21) Appl. No.: 11/316,805

(22) Filed: Dec. 27, 2005

(65) Prior Publication Data

US 2006/0166546 A1 Jul. 27, 2006

(30) Foreign Application Priority Data

Jan. 26, 2005 (JP) ..... 2005-018937

(51) Int. Cl.
*G08B 13/14* (2006.01)

(52) U.S. Cl. ..... 340/572.1; 340/572.4; 340/572.7; 340/572.8; 340/539.1; 340/687; 340/825.69

(58) Field of Classification Search ..... 340/572.1, 340/572.4, 572.7, 572.8, 539.1, 687, 825.69; 235/380, 383, 492; 370/338, 444; 439/373, 439/607

See application file for complete search history.

(56) References Cited

U.S. PATENT DOCUMENTS 5,357,091 A 10/1994 Ozawa et al.
5,786,626 A 7/1998 Brady et al.
5,910,776 A 6/1999 Black
6,002,331 A 12/1999 Laor
6,784,802 B1 8/2004 Stanescu
6,808,116 B1 10/2004 Eslambolchi et al.
7,259,679 B2 * 8/2007 Yoshida et al. ..... 340/572.8
7,306,489 B2 * 12/2007 Werthman et al. ..... 439/620.01
7,458,517 B2 * 12/2008 Durrant et al. ..... 235/492
2003/0061393 A1 3/2003 Steegmans et al.
2004/0242087 A1 12/2004 Hoshina
2006/0148279 A1 * 7/2006 German et al. ..... 439/49

FOREIGN PATENT DOCUMENTS

JP 2004-152543 5/2004

OTHER PUBLICATIONS

U.S. Appl. No. 11/039,824, filed Jan. 2005, Sakama.
Extended European Search Report Dated Jul. 2, 2009.

* cited by examiner

*Primary Examiner*—Hung T. Nguyen
(74) *Attorney, Agent, or Firm*—Brundidge & Stanger, P.C.

(57) ABSTRACT

A connector device used for electrical connection between electrical devices, including: a first connector; an IC chip disposed in a casing of the first connector; a first antenna disposed in the casing of the first connector, for wirelessly transmitting ID data of the IC chip stored in the IC chip in response to a signal from an external device; a second connector detachable from the first connector, electrically connecting the electrical devices when coupled to the first connector; and a second antenna disposed in a casing of the second connector, brought close to the first antenna to amplify and transmit a radio wave from the first antenna, when the first and second connectors are normally coupled together.

12 Claims, 12 Drawing Sheets

FIG.13

CHARACTERISTIC DATA MANAGEMENT TABLE

| PULSE WIDTH | | t0 | t1 | t2 | t3 |
|---|---|---|---|---|---|
| ID OF IC CHIP | TARGET FUEL FLOW | 0 | 90 | 180 | 270 |
| 0001 | MEASURED VALUE Q | 0 | 88 | 178 | 265 |
| 0002 | MEASURED VALUE Q | 0 | 85 | 183 | 270 |
| 0003 | MEASURED VALUE Q | 0 | 80 | 163 | 275 |
| 0004 | MEASURED VALUE Q | 0 | 92 | 190 | 281 |

FIG.14

CHARACTERISTIC DATA MANAGEMENT TABLE

| ID OF IC CHIP | TARGET FUEL FLOW | Q=0 | Q=90 | Q=180 | Q=270 |
|---|---|---|---|---|---|
| 0001 | CORRECTION PULSE WIDTHtj | 0.00 | 1.02 | 2.02 | 3.06 |
| 0002 | CORRECTION PULSE WIDTHtj | 0.00 | 1.05 | 1.98 | 3.00 |
| 0003 | CORRECTION PULSE WIDTHtj | 0.00 | 1.12 | 2.15 | 2.96 |
| 0004 | CORRECTION PULSE WIDTHtj | 0.00 | 0.98 | 1.90 | 2.88 |

CONNECTOR DEVICE, APPARATUS AND METHOD FOR ACQUIRING DATA OF ELECTRICAL DEVICE USING THE CONNECTOR DEVICE, AND CONTROL SYSTEM FOR ELECTRICAL DEVICE

CROSS-REFERENCE TO RELATED APPLICATION

The present application relates to subject matters described in a patent application Ser. No. 11/039,824 filed on Jan. 24, 2005 U.S. Pat. No. 7,352,285 entitled "IC TAG MOUNTING HARNESS AND HARNESS MOUNTING METHOD" and assigned to the assignees of the present application. The disclosures of this co-pending application are incorporated herein by reference.

INCORPORATION BY REFERENCE

The present application claims priority from Japanese application JP 2005-018937 filed on Jan. 26, 2005, the content of which is hereby incorporated by reference into this application.

BACKGROUND OF THE INVENTION

The present invention relates to a connector device having mounted thereon an IC tag wirelessly transmitting information recorded on an IC chip via an antenna, an apparatus and a method for acquiring data of an electrical device connected to the connector device, and a control system for controlling the electrical device based on the data read from the IC tag.

In recent years, IC tags are used to confirm the attributes associated with an article or confirm the connection state between plural electrical devices. For example, there has been disclosed a technique for mounting an IC tag onto an electrical connector to read information within the connector or to detect the fitting state of the connector. For example, an example of this technique has been described in JP-A-2004-152543 (refer to claims, paragraph Nos. 0027 to 0029, and FIG. 5). In the technique described in this document, the male side of an electrical connector has mounted thereon a tag chip constituted of an IC chip and a chip antenna, and when the male and female connectors are coupled, a reader/writer connected to an antenna performs non-contact reading of information of the tag chip by use of the antenna disposed on a substrate having fixed thereon the female side of the connector to thereby confirm the connection state of the connector.

More specifically, according to this technique, when plural electrical devices are connected to each other by an IC tag mounting harness with an connector having mounted thereon an IC tag, a reader/writer reads the information stored in the IC tag mounted on the connector of the IC tag mounting harness to confirm whether or not the electrical devices are unfailingly connected to each other by the IC tag mounting harness.

SUMMARY OF THE INVENTION

However, while the conventional technique described in the above described document is advantageous in that the tag chip information is difficult to leak out, this same technique is disadvantageous in that unless the reader/writer is within an extremely short distance from the antenna in the connector side, the tag chip information cannot be read. For example, when the tag chip information is read to check whether or not the connectors are normally attached to each other, the reader/writer must be brought extremely close to the tag chip antenna to check the fitting state, resulting in a problem of being inconvenient to use. In addition, according to the conventional techniques including the one described in the above document, while the connection state between the electrical devices connected by the IC tag mounting harness can be confirmed, it is not possible to manage the characteristic data of the electrical devices connected by the IC tag mounting harness or control the electrical devices by use of the IC tag information.

In view of the problems described above, the present invention has been achieved. An object of the present invention is to provide a connector device capable of easily checking the fitting state of a connector by reading information stored in an IC tag in the connector connected to an electrical device from a desired position, and an apparatus and a method for acquiring data information on the electrical device and controlling the electrical device when the electrical device is connected by the connector device.

To achieve the above object, the present invention provides a connector device used for electrical connection between electrical devices. The connector device comprises: a first connector; an IC chip disposed in a casing of the first connector; a first antenna disposed in the casing of the first connector, for wirelessly transmitting ID data of the IC chip stored in the IC chip in response to a signal from an external device; a second connector detachable from the first connector, electrically connecting the electrical devices when coupled to the first connector; and a second antenna disposed in a casing of the second connector, brought close to the first antenna to amplify and transmit a radio wave from the first antenna, when the first and second connectors are normally coupled together.

In this case, the radio wave transmitted from the chip antenna alone is weak and cannot thus be received by an external device. According to the present invention, however, when the first and second connectors are normally coupled, the radio wave from the chip antenna is amplified by the amplifying antenna. Accordingly, when the first and second connectors are normally coupled together, an ID stored in the IC chip can be read from the outside.

Also, when the ID stored in the IC chip is associated with the device ID of the first electrical device connected to the first connector, then based on the read ID, characteristic data of the first electrical device associated with that ID can be transmitted to another electrical device other than the first electrical device. Consequently, when the another electrical device connected to the second connector is an electronic control device, the first electrical device can be controlled based on characteristic data of the first electrical device associated with the ID stored in the IC chip. More specifically, based on the specific ID for each first electrical device, a control corresponding to the characteristic can be performed.

The present invention can also provide a control method for controlling an electrical device connected to the connector having mounted thereon an IC tag. In this case, after the device ID of an electrical device connected to the connector is associated with the ID stored in the IC chip, characteristic data of the electrical device is measured, associated with the above described ID and stored into a database. Accordingly, if the ID is read from the connector and the characteristic data associated with the ID is extracted, then based on the extracted characteristic data, the control of the electrical device and the management of the characteristic data can be performed according to the characteristic of the electrical device corresponding to the ID.

According to the present invention, if the first and second connectors are normally coupled to each other, when the connector is connected to an electrical device and the ID associated with the device ID of the electrical device is read from the IC chip mounted on the first connector, the characteristic data of the above described electrical device can be extracted by associating the electrical device with the ID. Also, when the electrical device is controlled based on the extracted characteristic data, even when a variation in characteristic between electrical devices exists, each electrical device can be properly controlled. For example, when a fuel injector for engine control is employed as the electrical device, the amount of injection can be controlled according to the fuel flux characteristics for each fuel injector. It is noted here that the scope of the present invention is not limited to a fuel injector disclosed in the description of embodiments.

Other objects, features and advantages of the invention will become apparent from the following description of the embodiments of the invention taken in conjunction with the accompanying drawings.

BRIEF DESCRIPTION OF THE DRAWINGS

FIG. 2A shows a state before being attached; FIG. 2B shows a state after being attached;

FIG. 13 is a view showing an injector characteristic data management table; and FIG. 14 is a view showing an injector characteristic data correction table.

DESCRIPTION OF THE EMBODIMENTS

Figure 1:
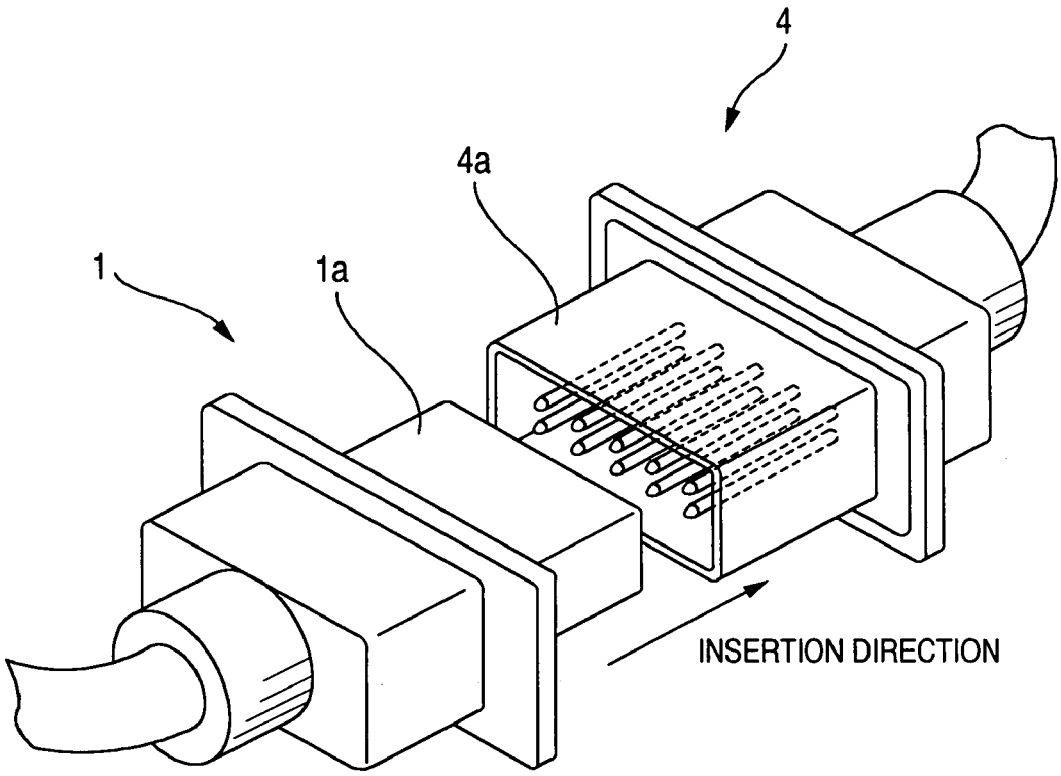
FIG. 1 is a view showing a structure of a wire harness having a connector used in each embodiment of the present invention.

Some preferred embodiments of a connector device according to the present invention, a method for acquiring data of an electrical device connected to the connector device, and a control method for controlling the electrical device based on the acquired data will be described below with reference to the drawings. It is noted that like reference numerals denote the same constituent elements throughout the drawings used in each embodiment described below.

Outline of Embodiments

Firstly the outline of an electrical connector (hereinafter referred to simply as a connector) according to embodiments of the present invention will be described. The connector according to embodiments of the present invention includes an IC chip and a chip antenna connected to the IC chip transmitting information recorded on the IC chip by a weak radio wave, mounted on one connector (a first connector) of a wire harness, and an amplifying antenna for amplifying and transmitting a weak (low power) radio wave transmitted from the chip antenna, mounted on the other connector (a second connector) of the wire harness. Mounting positions of the chip antenna and amplifying antenna are made close to have, for example, a distance of 1.0 mm or less (about 0.5 mm, for example) therebetween so as to make it possible for the amplifying antenna to amplify the radio wave from the chip antenna when the one connector of the wire harness is normally coupled to the other connector.

Consequently, when the first and second connectors are normally coupled together, the amplifying antenna amplifies a weak radio wave from the chip antenna and transmits the amplified radio wave. Thus, by receiving the radio wave at a reader/writer positioned at a desired distance from the connector, it is possible to detect whether or not the connectors are normally attached to each other. In addition, it is possible to read data (for example, an ID of an IC chip associated with a device ID of a connected electrical device) recorded on the IC chip in the first connector. When the characteristic data of the electrical device associated with the above described ID and stored in a database or the like is extracted, it is possible to control the electrical device corresponding to the read ID based on the extracted characteristic data.

When the IC chip is of writable type, the device ID can be written into the IC chip and used as the ID of the IC chip.

The outline of a control method for controlling an electrical device connected to the connector having mounted thereon this IC tag will now be described. Preliminarily, when the characteristic data of individual products of electrical devices have been measured in an electrical device manufacturing plant (a component maker, for example), the IDs of the individual electrical devices and the characteristic data are associated with each other, converted into a table, and stored in a database. Furthermore, when the IC chip is mounted on the first connector fixed to each electrical device, the ID of the IC chip is preliminarily associated with the device ID of the connected electrical device.

After manufactured in this way in the electrical device manufacturing plant (a component maker), the database and the electrical devices with connectors having mounted thereon IC tags are delivered to an electrical device assembly plant (a general assembly maker, for example) all at once. The information stored in the database can also be delivered online to the assembly plant via a computer network. In an electrical device assembly plant (a general assembly maker), when the second connector at the tip end of a cable extending from an ECU (Electronic Control Unit) is inserted into the first connector of an electrical device and connected to it, if the connection is normally made, the amplifying antenna mounted on the second connector amplifies a weak radio wave sent from the chip antenna mounted on the first connector and transmits the amplified radio wave. Then the transmitted ID of an IC chip is read by a reader/writer and the read ID is sent to the ECU, whereby the ECU reads the ID and thereby confirms a reliable connection between the connectors, and at the same time extracts from a database table the characteristic data of the electrical device associated with the read ID and performs a control based on the characteristic data for each electrical device. In this way, by reading from the IC chip in the first connector mounted on an electrical device the ID associated with the device ID of the electrical device, the ECU can not only confirm a normal connection between the connectors but also extract the characteristic data specific to each electrical device to perform a control based on the characteristic data (that is, function) specific to each electrical device. Accordingly, the electrical devices can be operated without being affected by a variation in characteristic, whereby the performance of electrical device can be further improved.

Embodiment 1

Firstly, in Embodiment 1, one embodiment of a connector device having applied thereto the present invention will be described. FIG. 1 is a view showing a connector part of a wire harness used in the embodiment of the present invention. A male connector 1 acting as the first connector is provided with an insertion end 1*a*, and a female connector 4 acting as the second connector is provided with a receiving frame 4*a*. When the insertion end 1*a* of the male connector 1 is inserted to the bottom of the receiving frame 4*a*, electrical devices (not shown) each connected to the first and second connectors 1 and 4 are electrically connected to each other. At this time, between the outer circumferential surface of the insertion end la and the inner circumferential surface of the receiving frame 4*a*, there is formed a predetermined gap. At least one of the first connector 1 and second connector 4 may also be directly fixed to the electrical device without provision of an extension wire cable. For example, one of the first connector 1 and second connector 4 may also be constructed integrally with the electrical device.

Figure 2A:
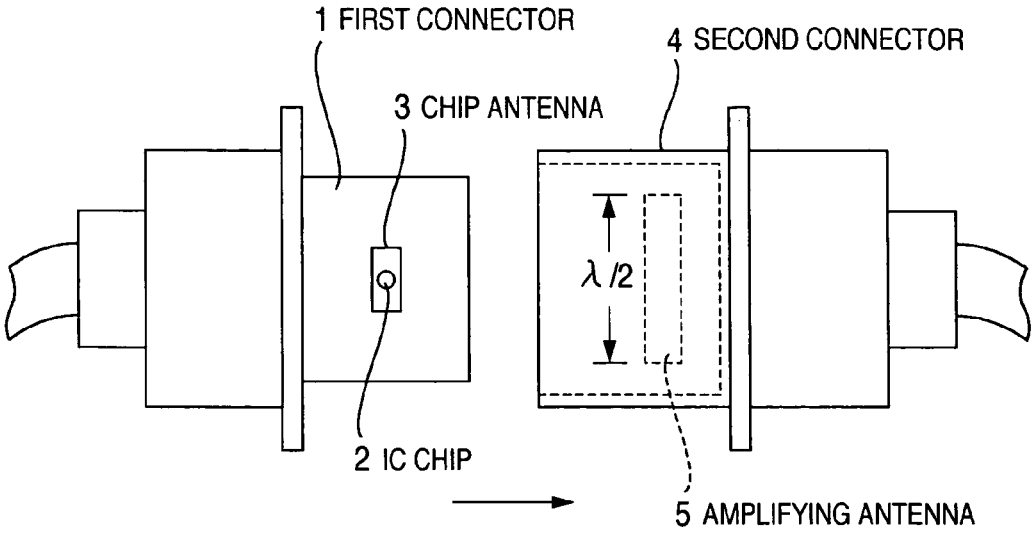
FIGS. 2A and 2B are schematic structure diagrams of a connector according to Embodiment 1 of the present invention.
Figure 2B:
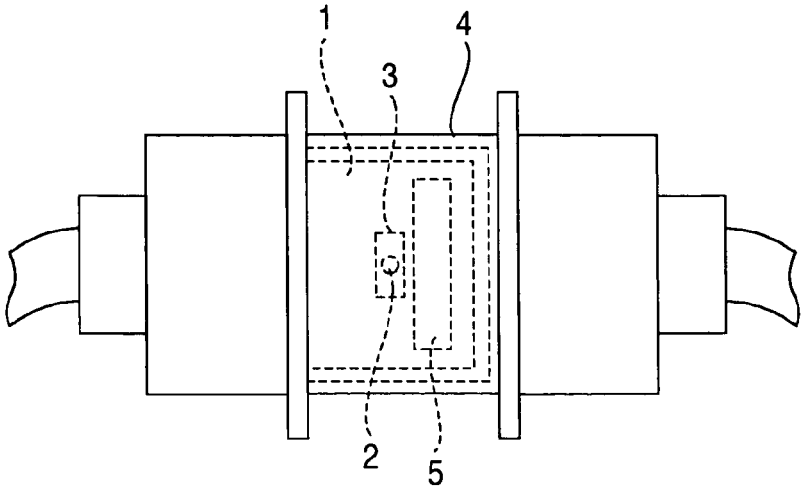

FIGS. 2A and 2B are schematic structure diagrams of a connector device according to Embodiment 1 of the present invention. FIG. 2A shows a state before being-coupled; FIG. 2B shows a state after being coupled. In the following description, for the sake of simplicity, the surface of the insertion end 1*a* of the first connector 1 is referred to as the surface of the first connector 1, and the surface or inner surface of the receiving frame 4*a* of the second connector 4 as the surface or inner surface of the second connector 4.

As shown in FIG. 2A, on the surface of the first connector 1 constituting a wire harness, there are attached an IC chip 2 and a chip antenna 3 connected thereto. The package of the IC chip 2 is, for example, as small as having a width, 0.4 mm, depth, 0.4 mm, and height, 0.1 mm. The IC chip 2 has recorded thereon an ID for distinguishing it from other IC chips. The chip antenna 3 connected to the IC chip 2 is as small as being incapable of transmitting a readable radio wave to the outside of the wire harness (i.e., being only capable of transmitting to a distance of several mm), and has the dimensions of a width, 1.6 mm and length, 7 mm.

On the surface or inner surface of the second connector 4 constituting the wire harness, there is attached an amplifying antenna 5 for amplifying a weak radio wave sent from the chip antenna 3 and transmitting the resultant radio wave to a desired direction. The length of this amplifying antenna 5 is $\lambda/2$; $\lambda$ is the wavelength of a radio wave in use, measured on a dielectric material as the base substance of the amplifying antenna 5. The width of the amplifying antenna 5 is about 1.6 mm, which is equal to that of the chip antenna 3. Mounting positions of the chip antenna 3 and amplifying antenna 5 are determined such that the distance between the chip antenna 3 and amplifying antenna 5 is 1.0 mm or less (about 0.5 mm, for example), whereby a radio wave sent from the chip antenna is amplified by the amplifying antenna when the first connector 1 and the second connector 4 are normally coupled to each other.

More specifically, as shown in FIG. 2B, when the first connector 1 and the second connector 4 are normally coupled to each other, the distance between the chip antenna 3 and amplifying antenna 5 becomes 1.0 mm or less (about 0.5 mm, for example). Consequently, a weak radio wave from the chip antenna 3 transmitting information stored in the IC chip 2 can be amplified by the amplifying antenna 5 and transmitted to a desired direction. In contrast, when the gap between the chip antenna 3 and amplifying antenna 5 is larger than 0.5 mm and thus the first connector 1 and the second connector 4 are not normally coupled to each other, then a weak radio wave from the chip antenna 3 will not be amplified and transmitted by the amplifying antenna 5.

When the connectors are normally coupled to each other in this way, an IC tag capable of transmitting a radio wave to the outside by the chip antenna 3 and amplifying antenna 5 can be constituted to transmit to the outside, information (an ID of an IC chip, for example) stored in the IC chip 2. Thus, when the information stored in the IC chip 2 attached to the connector is read by an external reader/writer, it can be detected whether or not the connectors have been normally attached.

The chip antenna 3 and amplifying antenna 5 in the connector device according to Embodiment 1 can be formed by vapor-depositing a metal thin film on the surface of the first connector 1 and the inner surface of the second connector 4, or can also be formed by attaching a metal foil onto the respective connectors. One of the first connector 1 and second connector 4 can also be firmly fixed directly to the electrical device or formed integrally with it.

Embodiment 2

In Embodiment 2, there will be described a method for acquiring data of an electrical device and controlling it when the electrical device is connected by the connector device having the configuration shown in FIGS. 2A and 2B. In Embodiment 2, by way of example, there will be described a method for connecting to the connector device a fuel injector (hereinafter referred to simply as an injector) injecting fuel to a vehicle engine, and for performing a control according to the characteristic of each injector.

Figure 3:
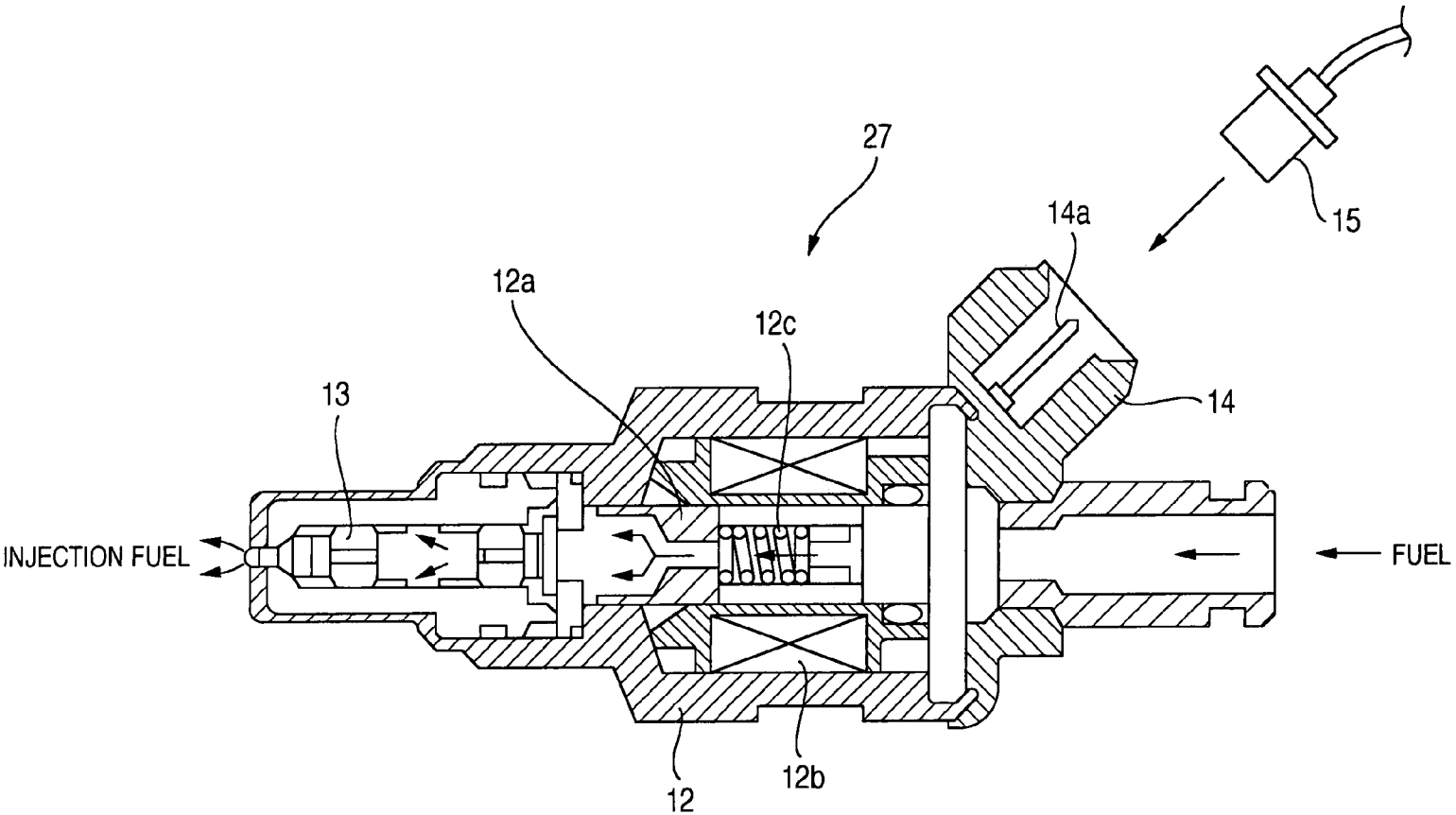
FIG. 3 is a cross sectional view of a fuel injector provided with a connector according to the present invention.

Firstly the control of an injector having applied thereto the present invention will be described. FIG. 3 is a cross sectional view of the injector. As shown in FIG. 3, the injector 27 comprises: a solenoid 12 constituted of a plunger 12*a*, a coil 12*b* driving the plunger 12*a*, and a spring 12*c* causing the plunger 12*a* to return when a voltage is not applied to the coil 12*b*; and a needle valve 13 opening and closing a valve seat when the plunger 12*a* is driven by an ON/OFF operation of the solenoid 12.

More specifically, when a voltage is applied to the coil 12*b* (i.e., when the solenoid 12 is turned on), the needle valve 13 is opened via the plunger 12*a* and a fuel supplied from the right side of FIG. 3 is converted to an injection fuel and injected from the needle valve 13 to the left of FIG. 3. When a voltage is not applied to the coil 12*b* (i.e., when the solenoid 12 is turned off), the spring 12*c* causes the plunger 12*a* to return and thus the needle valve 13 is closed to stop the injection fuel. At this time, the flux of injection fuel is controlled by the ratio of ON-time to one cycle interval (i.e., the sum of ON-time and OFF-time) of the ON/OFF operation of the solenoid 12 (hereinafter referred to as a duty ratio). The products of such injector 27 have variation in injection fuel flow characteristics relative to the same duty ratio, caused by a variation in manufacturing and a variation in assembly of components, such as the solenoid 12, and the needle valve 13.

As shown in FIG. 3, the injector 27 has a first connector 14 constituted integrally with the solenoid 12. Accordingly, if a corresponding second connector 15 is connected to the first connector 14, an electric power (a drive signal) can be supplied to the coil 12*b* from an external power source via a terminal 14*a*. That is, when the duty ratio in the ON/OFF operation of the solenoid 12 is controlled by an external control device via the first connector 14, an injection fuel flow control can be performed.

As described in FIGS. 2A and 2B, an IC chip 2 and a chip antenna 3 are mounted on the first connector 14 of FIG. 3, and an amplifying antenna 5 for amplifying a radio wave transmitted from the chip antenna 3 is mounted on the second connector 15 corresponding to the first connector 14. Accordingly, when the first connector 14 and the second connector 15 are normally connected to each other, if the amplifying antenna 5 amplifies and transmits a radio wave sent from the chip antenna 3 in response to a signal from an external reader/writer (not shown) and the reader/writer receives the ID of an IC chip as described above, then it is possible to confirm that the connection between the connectors has been unfailingly made. By associating the read ID with the device ID of the injector 27, the injector 27 can be identified by the ID of the IC chip. Referring to FIG. 3, the first connector 14 constituted integrally with the solenoid 12 is a female connector. However, a male connector (first connector) may be constituted integrally with the solenoid 12, and a female connector (second connector) may be connected to the first connector.

According to the structure of the connector device in the injector 27 shown in FIG. 3, the IC chip 2 and chip antenna 3 are mounted on the first connector 14, and the amplifying antenna 5 on the second connector 15. Except that the first connector 14 has no extension wire, this structure is identical to that explained in FIGS. 2A and 2B described above, and hence a detailed explanation thereof is omitted here.

Figure 4:
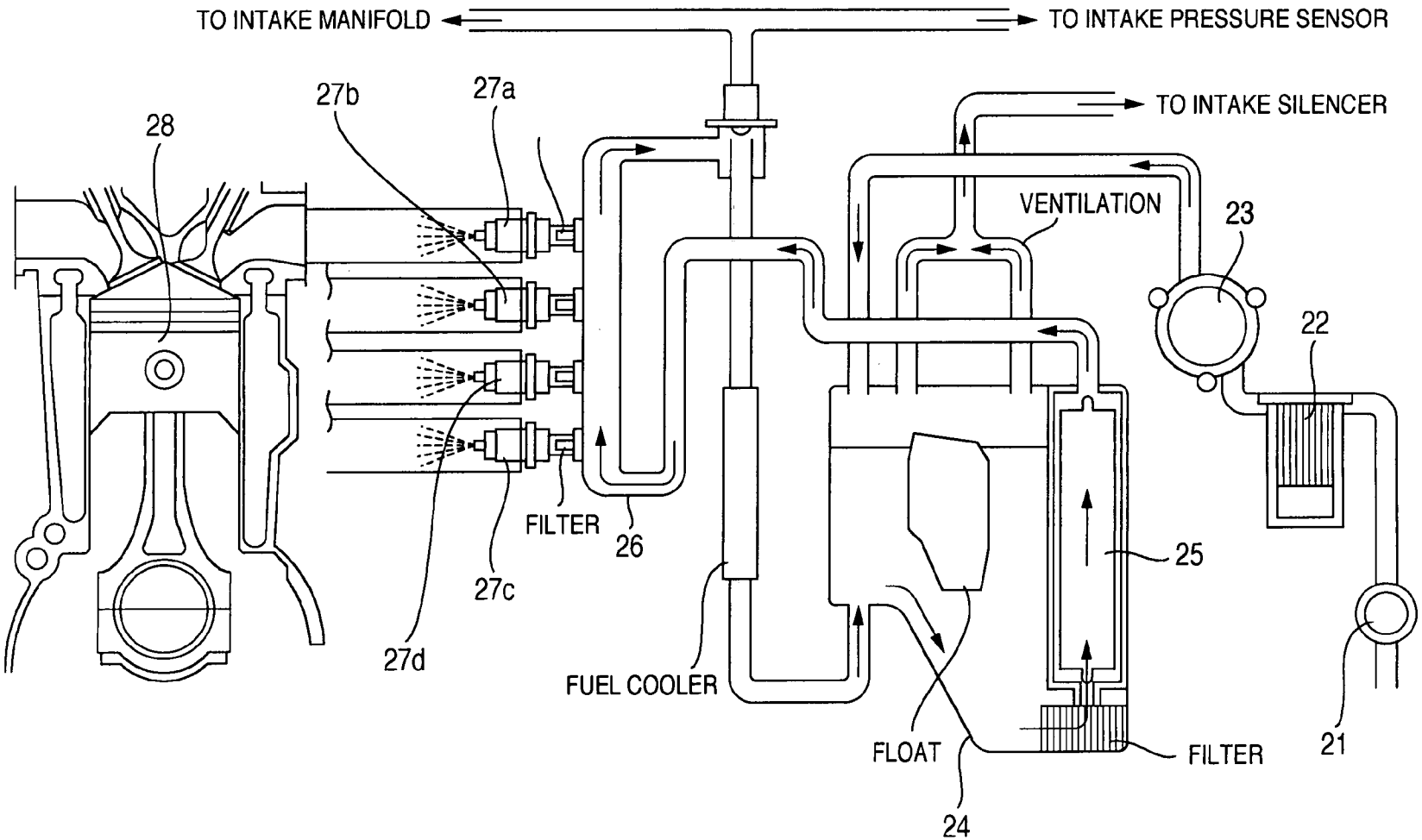
FIG. 4 is a schematic structure diagram of a four-cylinder engine using the injector shown in FIG. 3.

FIG. 4 is a schematic structure diagram of a four-cylinder engine using the injectors shown in FIG. 3. The four-cylinder engine as shown in FIG. 4 is based on a known technique, and hence an explanation of ordinary operation thereof is omitted here; the injector section according to the embodiment of the present invention will be mainly described. A fuel supplied from a fuel pump 21 is supplied to a vapor separator 24 via a fuel filter. 22 and a low-pressure fuel pump 23. The fuel is vaporized to a fuel-air mixture by a high-pressure fuel pump 25. The fuel-air mixture is supplied to injectors 27*a*, 27*b*, 27*c* and 27*d* corresponding to each combustion chamber of the four-cylinder engine via a fuel rail 26, converted to an injection fuel and injected to the corresponding cylinders to be burnt.

At this time, each injector 27 (27*a*, 27*b*, 27*c*, 27*d*), controlled by an ECU (not shown), injects the fuel to each cylinder according to a drive signal duty ratio, whereby the fuel is burnt inside each cylinder to drive each piston 28 of the four-cylinder engine. When such fuel injection is performed, IDs transmitted from each injector 27 is received by a reader/writer (not shown) positioned at a predetermined distance from each injector 27*a*, 27*b*, 27*c*, 27*d*, and sent to an ECU (not shown). By checking the ID thus sent, the ECU confirms the connection state of a cable extending to the injector 27 corresponding to the ID, and at the same time extracts based on the ID the fuel flow characteristics of the above described injector 27 from a table stored in a database, and performs based on the fuel flow characteristics an injection control of each injector 27.

Figure 5:
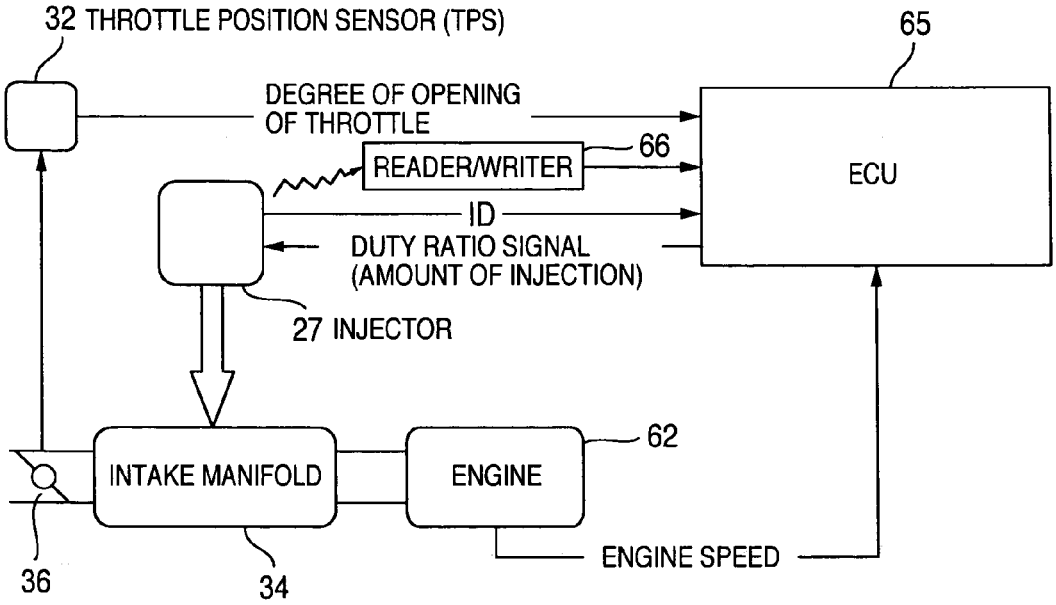
FIG. 5 is a block diagram showing a control function when the combustion control of the four-cylinder engine shown in FIG. 4 is performed.

FIG. 5 is a block diagram showing a control function when the four-cylinder engine shown in FIG. 4 is controlled. Referring to FIG. 5, the information on the degree of opening of a throttle 36 detected by a throttle position sensor (TPS) 32 is transmitted to an ECU 65. Based on the information on the degree of opening, the ECU 65 controls the injector 27. At this time, as described above, based on the ID of the IC chip received by a reader/writer 66 or a receiving function incorporated into the ECU 65, the flow characteristics of the injector 27 is extracted from a table stored in a database, and the duty ratio of a drive signal outputted to the injector 27 is corrected so as to have requested fuel flow characteristics. Accordingly, even when there is a variation in fuel flow characteristics between the four injectors, the control characteristics of each injector 27 (27*a*, 27*b*, 27*c*, 27*d*) become uniform, whereby the fuel injection can be-performed as requested. The injected fuel is supplied from an intake manifold 34 to a cylinder of an engine 62, and mixed with air by a proper mixture ratio to be burnt. The engine speed is detected by a sensor and feedbacked to the ECU 65. The ECU 65 controls the degree of opening of a throttle 36 and the duty ratio for the injector 27, and thereby controls the engine 62.

Embodiment 3

In Embodiment 3, there will be described a method for acquiring characteristic data and control data required for controlling an injector. To realize the method for acquiring data, it is needed to divide the data processing into two parts, respectively, performed by an injector manufacturing plant manufacturing the injector 27 having incorporated therein the connector device provided with the IC tag and by a vehicle assembly plant assembling a vehicle by use of the injector 27; each of the plants must manage data individually. In the injector manufacturing plant, characteristic data is acquired from the fuel flow characteristics for each manufactured injector, and the device ID of the injector 27 corresponding to the acquired characteristic data is associated with the ID of an IC chip mounted on the first connector 14 attached to the injector 27 to thereby create a table and store the table in a database. The database and the injector being a component are delivered to the vehicle assembly plant. Of course, the database can also be delivered to the vehicle assembly plant via a computer network.

On the other hand, in the vehicle assembly plant, the database having stored therein the table of characteristic data, and the injector 27 being a component are received. When a vehicle is assembled, a characteristic data management apparatus 51 (refer to FIG. 10) reads the table of characteristic data from the database, creates correction data used to control the injector 27, and stores it in a characteristic data correction table 54. The correction data thus stored is downloaded into an ECU controlling the engine of a vehicle and used by the ECU. In this case, the characteristic data management apparatus 51 reads the ID of an IC chip 2 mounted on the first connector 14 of the injector 27 incorporated into the engine 62. Based on the read ID, a characteristic data download unit 55 (refer to FIG. 10) downloads the correction data corresponding to the above described injector 27 from the characteristic data correction table 54 (FIG. 10) to the ECU 65 and causes the correction data to be stored in the ECU 65. Accordingly, when the ECU 65 controls the injector 27, the ECU can correct the duty ratio being a control quantity of the injector 27, by use of the correction data. Thus the fuel injection can be performed without a variation between injectors 27.

Figure 6:
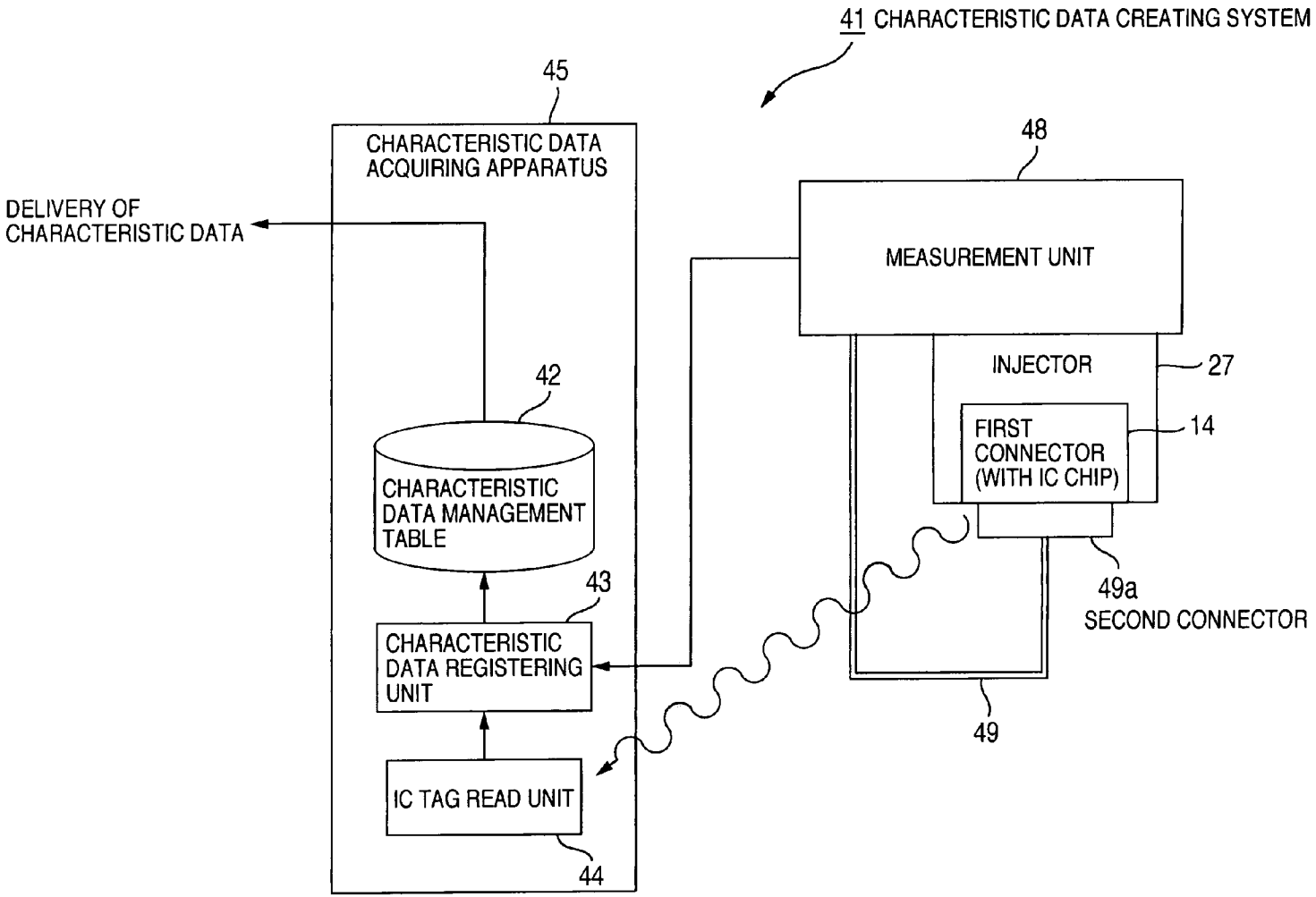
FIG. 6 is a configuration diagram of a characteristic data creating apparatus creating a database having stored therein injector characteristic data in an injector manufacturing plant.

FIG. 6 is a configuration diagram of a characteristic data creating system 41 creating a database having stored therein characteristic data in an injector manufacturing plant.

Referring to FIG. 6, the characteristic data creating system 41 comprises: a characteristic data acquiring apparatus 45 including a characteristic data management table 42, a characteristic data registering unit 43 and an IC tag read unit (reader/writer) 44; and a measurement unit 48 measuring the flux characteristics of an injector 27. The measurement unit 48 and the injector 27 are connected to each other via a cable 49. A second connector 49*a* is provided in the injector side at the end of the cable 49, and the amplifying antenna 5 described above is provided in the second connector 49*a*. Consequently, when the cable 49 is normally connected to the injector 27, the ID of an IC chip 2 mounted on a first connector 14 of the injector 27 is read by the IC tag read unit 44 via an amplifying antenna 5.

The flow of creating a database of characteristic data will now be described with reference to the flowchart shown in FIG. 7.

In the injector manufacturing plant, firstly an injector 27 is manufactured (step S1), and a first connector 14 is built into each injector (step S2), whereby as shown in FIG. 3, the first connector 14 having attached thereto an IC chip 2 and a chip antenna 3 is integrally attached to a solenoid 12.

Fuel flow characteristics are measured with respect to each manufactured injector 27. To perform this, a characteristic data creating apparatus 41 shown in FIG. 6 is used. A second connector 49*a* of a cable 49 extending from a measurement unit 48 of the characteristic data creating apparatus 41 is inserted into the first connector 14 of the injector 27 to thereby electrically connect the measurement unit 48 and the injector. As described above, the second connector 49*a* has mounted thereon an amplifying antenna 5. Thus, when the connectors are normally connected to each other, the ID of the IC chip attached to the female connector 14 is wirelessly transmitted to the outside in response to a read signal sent from the outside (a characteristic data acquiring apparatus 45, for example). The ID is read by an IC tag read unit 44 (step S3). The ID thus read is associated with the device ID of the above described injector 27 and registered to a characteristic data registering unit 43 (step S4).

After such preparatory operation, the measurement unit 48 outputs to the injector 27, control signals having some different duty ratios via the cable 49 and thereby measures the fuel flow characteristics of the injector 27. The fuel flow characteristics are sampled to acquire the characteristic data (step S5).

Here, "characteristic data of an injector" means fuel flow characteristics relative to duty ratio.

Figure 8:
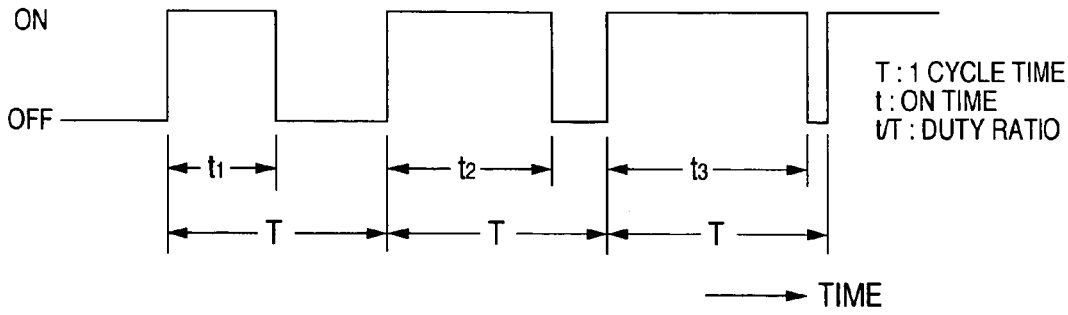
FIG. 8 is a view showing a waveform of control signal outputted to the injector.

FIG. 8 is a view showing a waveform of control signal outputted to the injector 27. As shown in FIG. 8, ON-time t is varied continually from t1 to t2 to t3 relative to one cycle time T of ON/OFF (i.e., duty ratio is varied), whereby the amount of fuel injection of the injector 27, i.e. fuel flow, is varied. The flux characteristics of the injector 27 are obtained from the relationship between the duty ratio and fuel flow.

Figure 9:
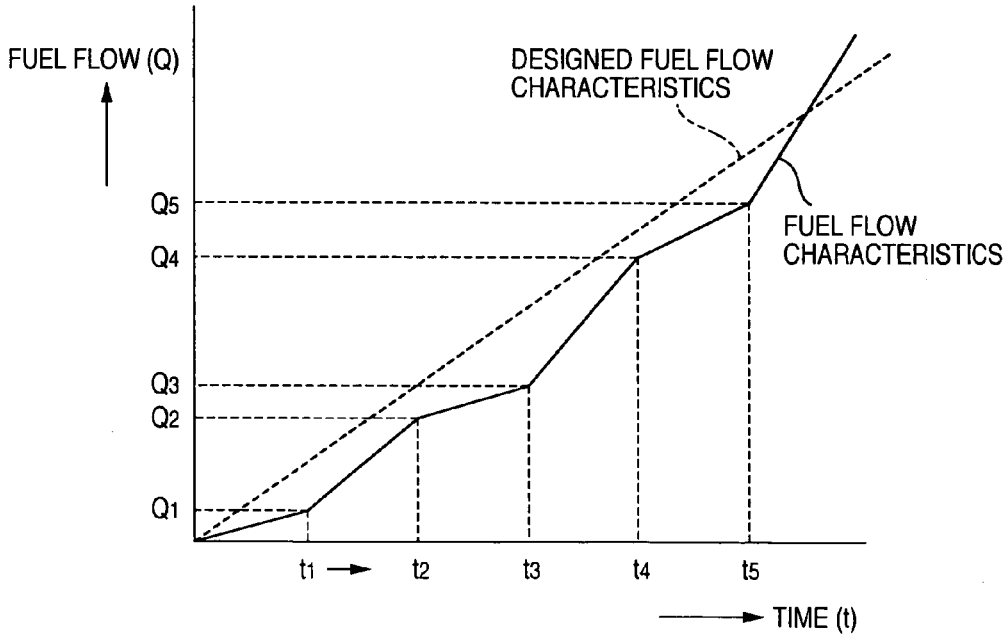
FIG. 9 is a view showing measured fuel-flow characteristics of the injector.

FIG. 9 is a view showing measured fuel flow characteristics of the injector; when ON time t of solenoid is plotted along the abscissa and fuel flow Q along the ordinate, then the fuel flow characteristics as shown in FIG. 9 can be obtained. Here, Q denotes fuel flow, and t denotes ON-time of solenoid. The fuel flow characteristics do not perfectly agree with designed fuel flow characteristics due to a variation etc. in manufacturing of injectors. Consequently, when the duty ratio of injector is controlled based on designed fuel flow characteristics data, an error in fuel flow injected from the injector 27 occurs. To eliminate this error, it is needed to correct the duty ratio (pulse width t) being a control quantity according to the fuel flow characteristics of the individual injectors 27.

Figure 7:
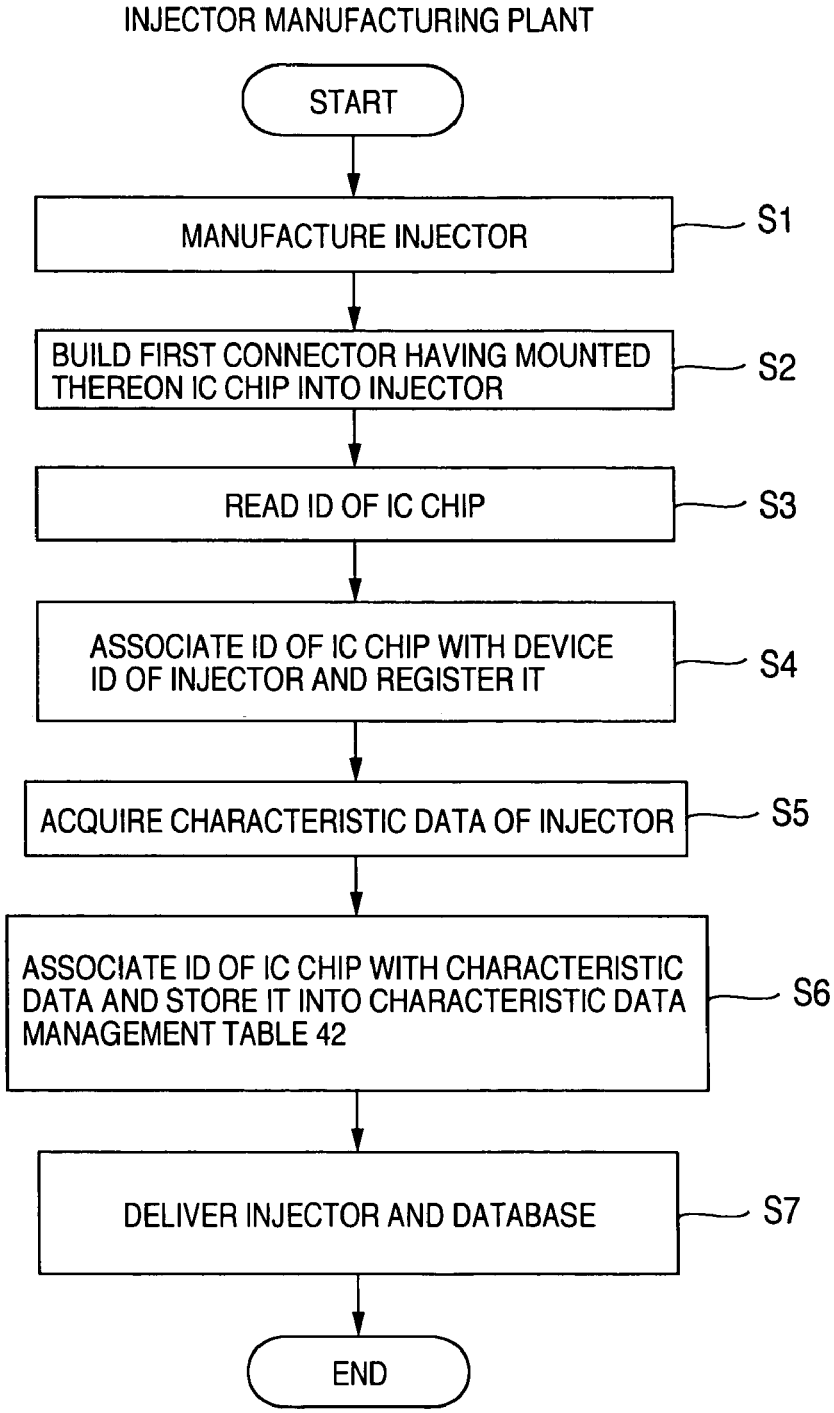
FIG. 7 is a flowchart for explaining a flow of database creation.

Returning to the flowchart of FIG. 7, in the injector manufacturing plant, the characteristic data (measured value Q) obtained by sampling the measured injector fuel flow characteristics is associated with the ID of the IC chip read in the step S3, and stored in a characteristic data management table 42 shown in FIG. 13 (step S6). On this characteristic data management table, there is recorded the target fuel flow corresponding to pulse width t used when obtaining the measured value. The difference between the measured value and target fuel flow corresponds to the fuel flow to be corrected. This characteristic data management table 42 is stored into a database, and the injector 27 and database are delivered all at once to a vehicle assembly plant (step S7).

In the above described example, there was described a configuration in which the database having stored therein the characteristic data management table 42 having the characteristic data associated with the ID of the IC chip corresponding to the device ID of each injector 27 is delivered to a vehicle assembly plant together with the injector 27 being a product. However, the characteristic data management table shown in FIG. 13 may be delivered via a recording medium such as a CD, or may alternatively be downloaded to the vehicle assembly plant side via a computer network.

The use of characteristic data in a vehicle assembly plant assembling a vehicle will now be described.

Figure 10:
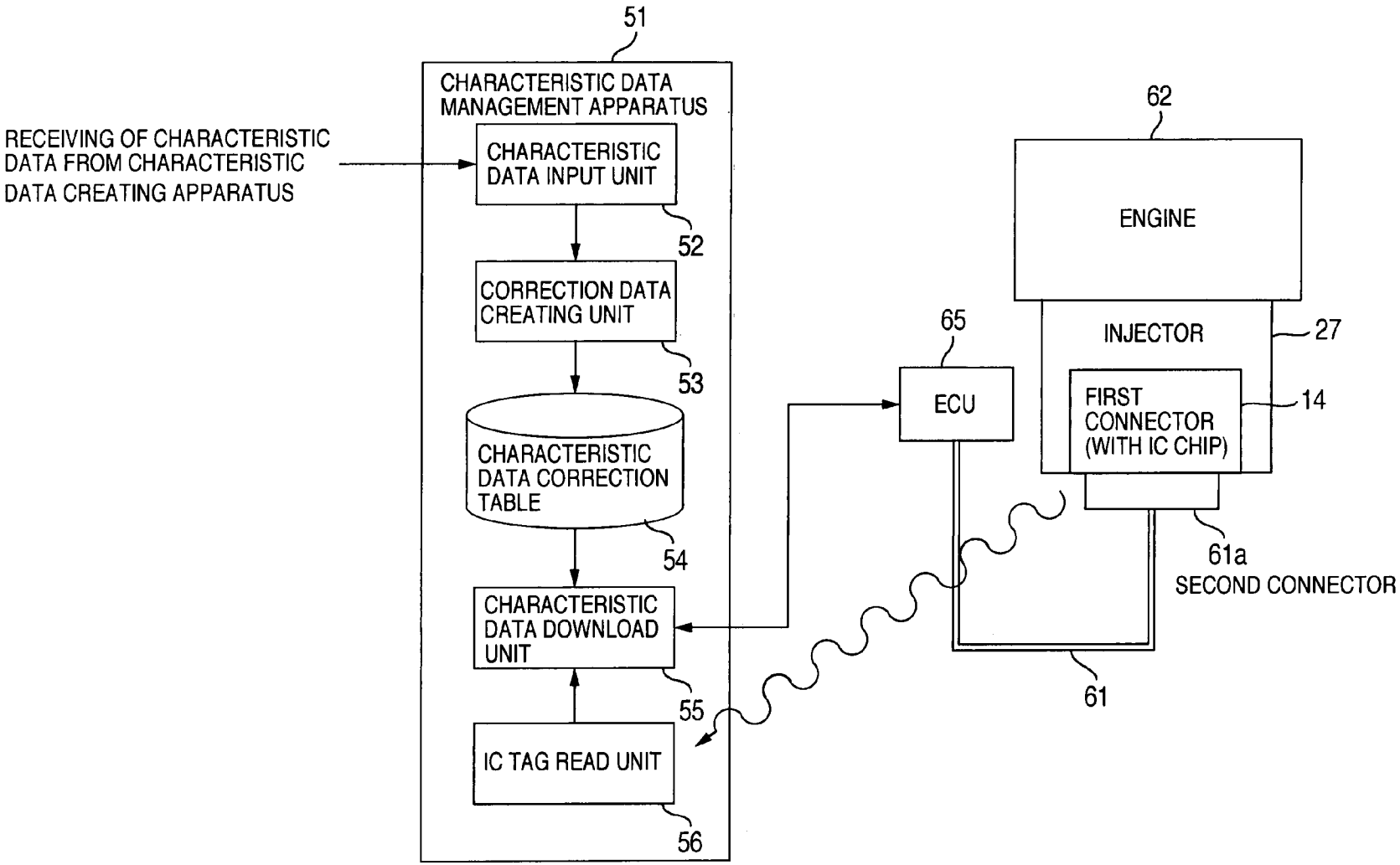
FIG. 10 is a configuration diagram of a characteristic data management apparatus used in a vehicle assembly plant.

FIG. 10 is a configuration diagram of a characteristic data management apparatus used in a vehicle assembly plant.

Referring to FIG. 10, a characteristic data management apparatus 51 comprises a characteristic data input unit 52, a correction data creating unit 53, a characteristic data correction table 54, a characteristic data download unit 55 and an IC tag read unit (reader/writer) 56. The injector 27 is mounted on an engine 62 of vehicle, and at the same time the injector 27 and the ECU 65 being the control device of the engine 62 are connected to each other via a cable 61. An amplifying antenna 5 described above is mounted on a second connector 61*a* of the cable 61. Accordingly, when the second connector 61*a* is inserted into a first connector 14 and the connection of the cable 61 is normally made, then the ID of an IC chip 2 mounted on the first connector 14 is transmitted to the outside in response to a read signal received from the outside.

The correction and control of characteristic data of the injector 27 in the ECU will now be described with reference to a flowchart shown in FIG. 11.

Figure 11:
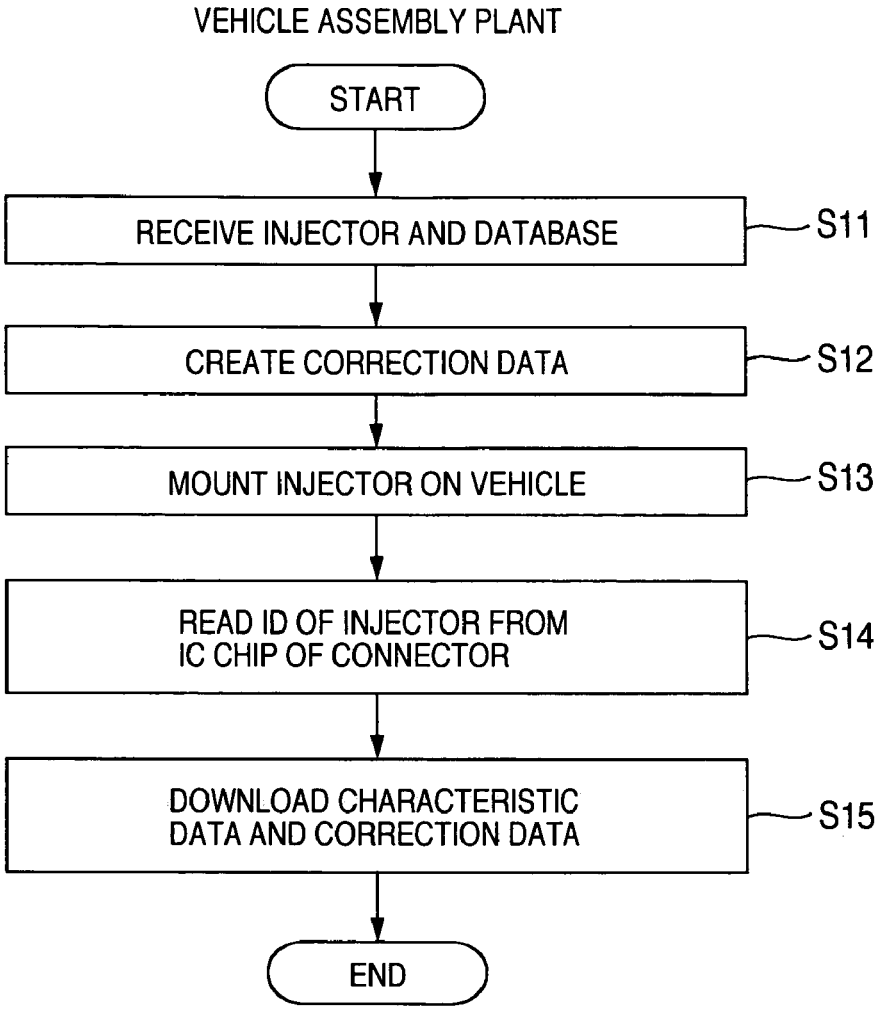
FIG. 11 is a flowchart for explaining how to use the injector characteristic data management apparatus.
Figure 12:
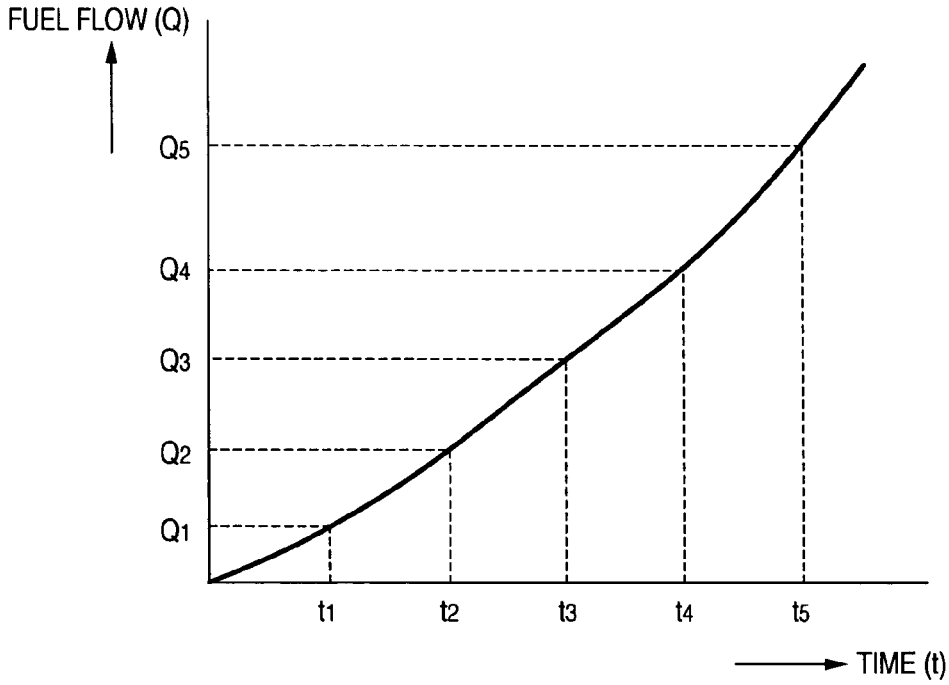
FIG. 12 is a view showing the fuel-flow characteristics of the injection after correction.

Referring to FIG. 11, the vehicle assembly plant receives the injector 27 being a product, and the database having stored therein the characteristic data management table 42 shown in FIG. 13 (step S11), and the characteristic data management table 42 stored in the database is supplied to the correction data creating unit 53 by the characteristic data input unit 52. The correction data creating unit 53 calculates a difference between the target fuel flow and the measured value with respect to each measured value for each injector. Correction data is created to correct this difference. The correction data, i.e., correction pulse width tj can be determined, for example, by calculating the following formula based on the slope factor of designed fuel flow characteristics shown in FIG. 9.

$$tj=t+\Delta Q/m$$

where t denotes a pulse width corresponding to target flux, ΔQ denotes a difference between target fuel flow (designed fuel flow) and measured value, and m denotes a slope factor of designed fuel flow characteristics.

The correction pulse width tj of each injector 27 calculated in this way is associated with the target fuel flow and stored into the characteristic data correction table 54. FIG. 14 is a view showing the characteristic data correction table 54. Here, the correction pulse width tj for each ID of the IC chip is associated with each target fuel flow.

The method for correcting the pulse width t is not limited to the above described one, but various methods are possible. FIG. 14 is obtained by performing linear interpolation between observed values. However, instead of linear interpolation, a method based on polynomial interpolation or the like is also possible.

Subsequently, in the vehicle assembly plant, the injector 27 is mounted on the vehicle engine 62, and the ID of the IC chip 2 mounted on the first connector 14 of the injector 27 is read by the IC tag read unit 56 (step S14). The ID thus read is outputted to the characteristic data download unit 55. The characteristic data download unit 55 transmits to an ECU 65 the correction pulse width tj being correction data associated with the ID (step S15), whereby the ECU 65 acquires the correction pulse width tj of each injector 27 mounted on the vehicle engine 62.

In controlling the engine 62, when the ECU 65, provided with a reader/writer function, receives the ID from the IC chip 2 by the reader/writer function, the ECU confirms that the cable 61 is unfailingly connected to the injector 27, and further extracts the correction pulse width tj of the injector 27 to be controlled from among the stored correction pulse width tj data based on the ID and the target fuel flow, and outputs the correction pulse width tj to the injector 27 (27*a*, 27*b*, 27*c*, 27*d*). In this way, in controlling the injector 27, the pulse width correction is made according to the fuel flow characteristics of each injector 27, and thus the individual injectors can perform fuel injection as requested according to fuel flow characteristics close to a straight line. That is, the individual injectors can perform fuel injection according to uniform fuel flow characteristics. Consequently, fuel can be burnt by a proper air-fuel ratio.

In the above description of the embodiments of the present invention, a case where the electrical devices connected to the connector device were a fuel injector of an engine and an ECU was taken as an example. However, the present invention is not limited to this example. Electrical devices to which the present invention is applied include an electrically-operated steering device of an automobile, a motor and an actuator for driving an electrically-operated brake, and an electrical control unit for controlling the motor and actuator, and a motor for various electrical appliances and an electrical control unit for the motor, and a compressor for an air conditioner. The connector device can be used to acquire characteristic data for these electrical devices and control them. These motors and actuators can be controlled similarly to the injector according to the embodiments of the present invention.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A control system for an electrical device comprising: a first connector; an IC chip disposed in a casing of the first connector; a first antenna disposed in the casing of the first connector, for wirelessly transmitting ID data from the IC chip; a second connector detachable from the first connector, electrically connecting the electrical device when coupled to the first connector; a second antenna disposed in a casing of the second connector, brought close to the first antenna to amplify and transmit a radio wave from the first antenna, when the first and second connectors are normally coupled together; a control device electrically coupled to the second connector; a database having recorded thereon characteristic data of the electrical device corresponding to the ID data of the IC chip, wherein the control device reads the characteristic data of the electrical device corresponding to the ID data of the IC chip and controls the electrical device based on the characteristic data;

an IC tag read unit for reading ID data of the electrical device electrically connected to the first connector, via an antenna disposed in the second connector coupled to the first connector; a characteristic data input unit for receiving the characteristic data of the electrical device from the outside; a correction data creating unit for determining an error in the characteristic data relative to basic characteristic data of the electrical device; a characteristic data correction table having recorded thereon the I D data read by the IC tag read unit, associated with the correction data of the electrical device; and a characteristic data download unit for outputting the correction data of the electrical device from the characteristic data correction table in response to a request from the outside.

2. The system according to claim 1, wherein: the electrical device is a fuel injector of an engine; and the characteristic data of the electrical device are fuel injection quantity characteristics of the fuel injector.

3. The control system according to claim 1, further comprising:

an IC tag read unit for reading ID data of an electrical device electrically connected to the first connector, via an antenna disposed in the second connector coupled to the first connector;

a characteristic data registering unit for receiving and storing the characteristic data of the electrical device; and a characteristic data management table having recorded thereon the characteristic data of the electrical device, associated with ID data of the first connector connected to the electrical device.

4. The control system according to claim 3, wherein the electrical device is a fuel injector of an engine; and the characteristic data of the electrical device are fuel injection quantity characteristics of the fuel injector.

5. The control system according to claim 1, wherein the electrical device is a fuel injector of an engine, and the characteristic data of the electrical device are fuel injection quantity characteristics of the fuel injector.

6. A control method for an electrical device comprising the steps of: transmitting ID data of an IC chip mounted on a first connector electrically coupled to the electrical device from a first antenna mounted on the first connector; reading, by a control device electrically coupled to the second connector, the ID data from the first antenna via a second antenna mounted on a second connector coupled to the first connector; reading based on the read ID data of the IC chip, control data of the electrical device corresponding to the ID data of the IC chip from a database stored in the control device, and controlling the electrical device based on the control data;

coupling to the first connector the second connector electrically coupled to the control device; acquiring data having the ID data of the IC chip, associated with measured characteristic data of the electrical device; creating correction data for correcting an error in the measured characteristic data of the electrical device relative to basic characteristic data; transmitting the ID data of the IC chin mounted on the first connector from a first antenna mounted on the first connector; reading, by reading means, the ID data transmitted from the first antenna via the second antenna; and creating data having the read ID data of the IC chip associated with the correction data of the electrical device and supplying the data to the control device.

7. The method according to claim 6, wherein: the electrical device is a fuel injector of an engine; and the characteristic data of the electrical device are fuel injection quantity characteristics of the fuel injector.

8. The method according to claim 6, further comprising the steps of:

coupling to the first connector electrically coupled to the electrical device the second connector electrically coupled to a measurement apparatus;

transmitting the ID data of the IC chip from the first antenna; and reading, by reading means, the ID data transmitted from the first antenna via the second antenna.

9. The method according to claim 8, further comprising the steps of:

associating the read ID data of the IC chip with ID data of the electrical device;

measuring, by the measurement apparatus, a characteristic of the electrical device; and creating data having the measured characteristic associated with the ID data of the IC chip and recording the data.

10. The method according to claim 9, wherein the electrical device is a fuel injector of an engine; and the characteristic data of the electric device are fuel injection quantity characteristics of the fuel injector.

11. The method according to claim 6, wherein the electrical device is a fuel injector of an engine, and the characteristic data of the electrical device are fuel injection quantity characteristics of the fuel injector.

12. The method according to claim 6, wherein the step of acquiring data having ID data of the IC chip associated with measured characteristic data of the electrical device is performed via a computer network.

* * * * *